US007568680B2

(12) United States Patent
Platt

(10) Patent No.: US 7,568,680 B2
(45) Date of Patent: Aug. 4, 2009

(54) RAIL CLIP ASSEMBLY FOR CONNECTING A FENCE RAIL TO A FENCE POST

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 112 days.

(21) Appl. No.: 11/485,849

(22) Filed: Jul. 12, 2006

(65) Prior Publication Data

US 2007/0241316 A1 Oct. 18, 2007

Related U.S. Application Data

(63) Continuation-in-part of application No. 11/405,840, filed on Apr. 18, 2006.

(51) Int. Cl.
*E04H 17/00* (2006.01)

(52) U.S. Cl. ..... 256/65.04; 256/65.02; 256/65.03

(58) Field of Classification Search ..... 256/1, 256/19, 65.01–65.05, 65.12, 67, 69, DIG. 2, 256/12

See application file for complete search history.

(56) References Cited

U.S. PATENT DOCUMENTS 2,941,855 A * 6/1960 Weill ..... 403/237
3,233,871 A * 2/1966 Schroer ..... 256/69
3,867,048 A * 2/1975 Endzweig ..... 403/252
4,355,919 A * 10/1982 Lievonen ..... 403/191
4,386,870 A * 6/1983 Baroody ..... 403/234
4,570,906 A * 2/1986 Walden ..... 256/34
5,083,390 A * 1/1992 Edman ..... 40/607.02
5,370,368 A * 12/1994 Terrels et al. ..... 256/19
5,788,224 A * 8/1998 Platt ..... 256/66
6,805,335 B2 * 10/2004 Williams ..... 256/67
6,811,346 B2 * 11/2004 Liao ..... 403/230
7,007,363 B2 * 3/2006 Forbis ..... 29/428

* cited by examiner

*Primary Examiner*—Daniel P Stodola
*Assistant Examiner*—Nahid Amiri
(74) *Attorney, Agent, or Firm*—Sand & Sebolt

(57) ABSTRACT

A rail clip assembly for connecting a horizontal fence rail to a vertical fence post. The rail clip assembly comprises a housing that is slidably engaged with at least one mounting spacer and a first leg of an L-shaped mounting bracket. The second leg of the mounting bracket abuts the underside of the housing and supports the same. An end of the rail is inserted into a chamber formed in the housing and a fastener is used to secure the second leg of the mounting bracket, the housing and the end of the rail together. The rail clip assembly aids in preventing the rail from disengaging from the housing when a lateral force is applied to the rail.

14 Claims, 7 Drawing Sheets

RAIL CLIP ASSEMBLY FOR CONNECTING A FENCE RAIL TO A FENCE POST

CROSS-REFERENCE TO RELATED APPLICATIONS

This is a continuation-in-part of U.S. patent application Ser. No. 11/405,840, filed Apr. 18, 2006, the entire specification of which is incorporated herein by reference.

BACKGROUND OF THE INVENTION

1. Technical Field

This invention generally relates to fencing systems. More particularly, the invention relates to a rail clip assembly for securing a fence rail to a fence post. Specifically, the invention relates to a rail clip assembly which reduces the tendency of the rail from disengaging from the fence post when a lateral force is applied to the rail; and that includes a housing, an angled mounting bracket and at least one mounting spacer.

2. Background Information

A variety of rail clips have been proposed in the prior art for connecting vinyl fence rails to vinyl fence posts. These clips have typically included a mounting base portion that is secured to the rail and which includes a rail-end shaped receptacle to receive the end of the rail therein. One of the reasons these rail clips have been used is to provide a neat, finished connection between the two components. The clips hide incorrectly cut rail ends, evidence of previous attempts to connect the rail and post together and the apparent elimination of gaps between the connected rail ends and the posts. In order to provide a more aesthetically-pleasing device, it is common for the rail clip to be in the magnitude of one to two inches deep. Rail clips that are deeper than this tend to give the rail a cumbersome appearance.

A second consideration when connecting fence rails to fence posts is the existence of rules and regulations governing building standards. In recent years, building codes have required that the rail clip provided must ensure that the end of the rail cannot pop out of the rail clip when a lateral force is applied to the rail. In other types of rail connectors, the rail clip itself is slidably engaged with a mounting base that is first secured to post. In this type of situation, the rail clip has tended to pop off the mounting base, thereby releasing the rail.

There is therefore a need in the art for a rail clip assembly that will connect a horizontal rail to a vertical post and that will resist the tendency for the rail to pop out of the clip when a lateral force is applied to the rail.

SUMMARY OF THE INVENTION

The device of the present invention is a rail clip assembly for connecting a horizontal fence rail to a vertical fence post. The rail clip assembly comprises a housing that is slidably engaged with a first leg of an L-shaped mounting bracket and at least one mounting spacer that are secured to the fence post. A second leg of the mounting bracket abuts the underside of the housing and supports the same. An end of the rail is inserted into a chamber formed in the housing and a fastener is used to secure the second leg of the mounting bracket, the housing and the end of the rail together. The rail clip assembly aids in preventing the rail from disengaging from the housing when a lateral force is applied to the rail.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
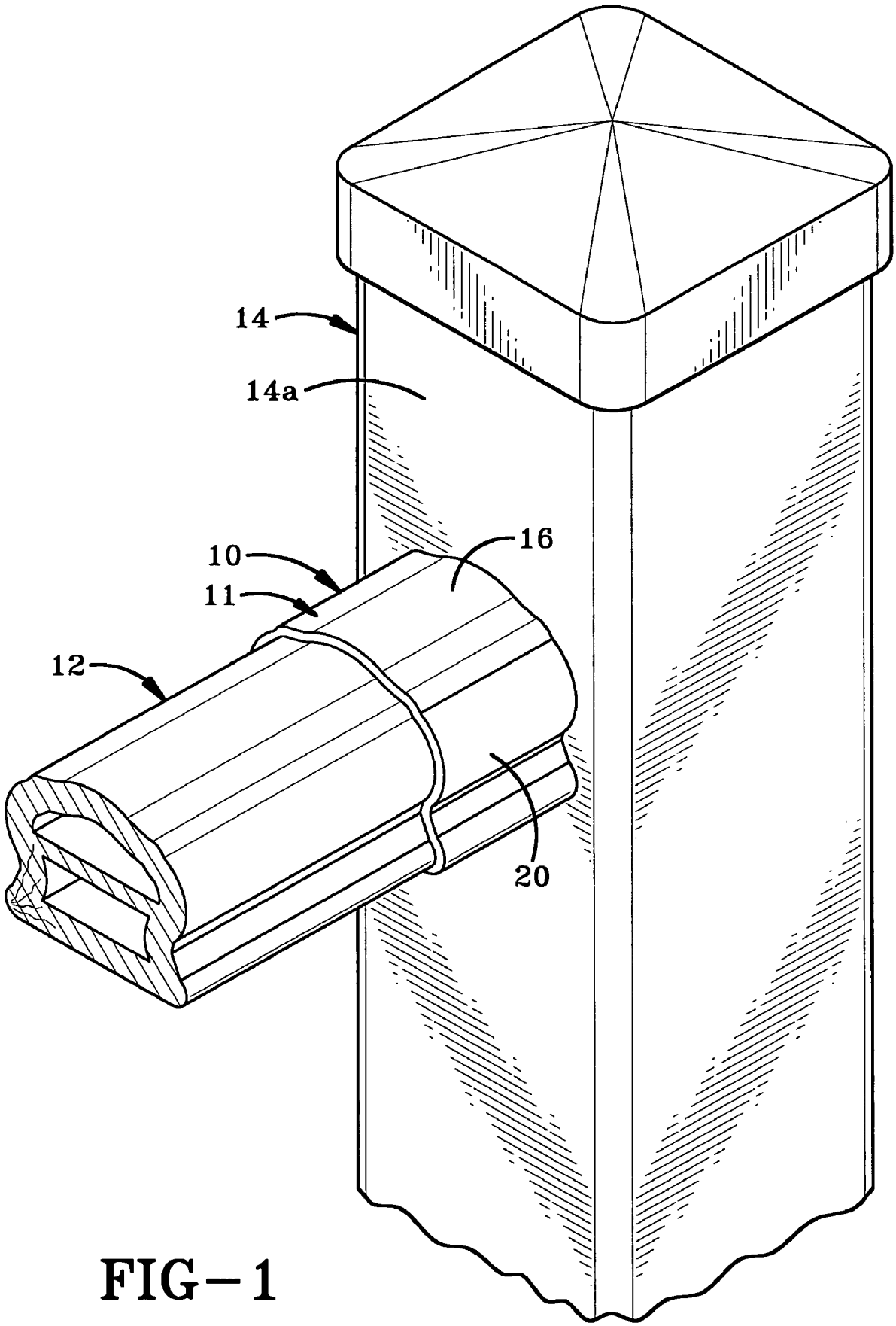
FIG. 1 is a perspective view of a fence rail connected to a fence post using the rail clip assembly of the present invention.

Referring to FIG. 1, there is shown a rail clip assembly in accordance with the present invention and being generally indicated at 10. Rail clip assembly 10 is shown in FIG. 1 securing a substantially horizontal fence rail 12 to a substantially vertical fence post 14. Both rail 12 and post 14 are preferably manufactured from vinyl or fiber composite fencing materials.

Figure 2:
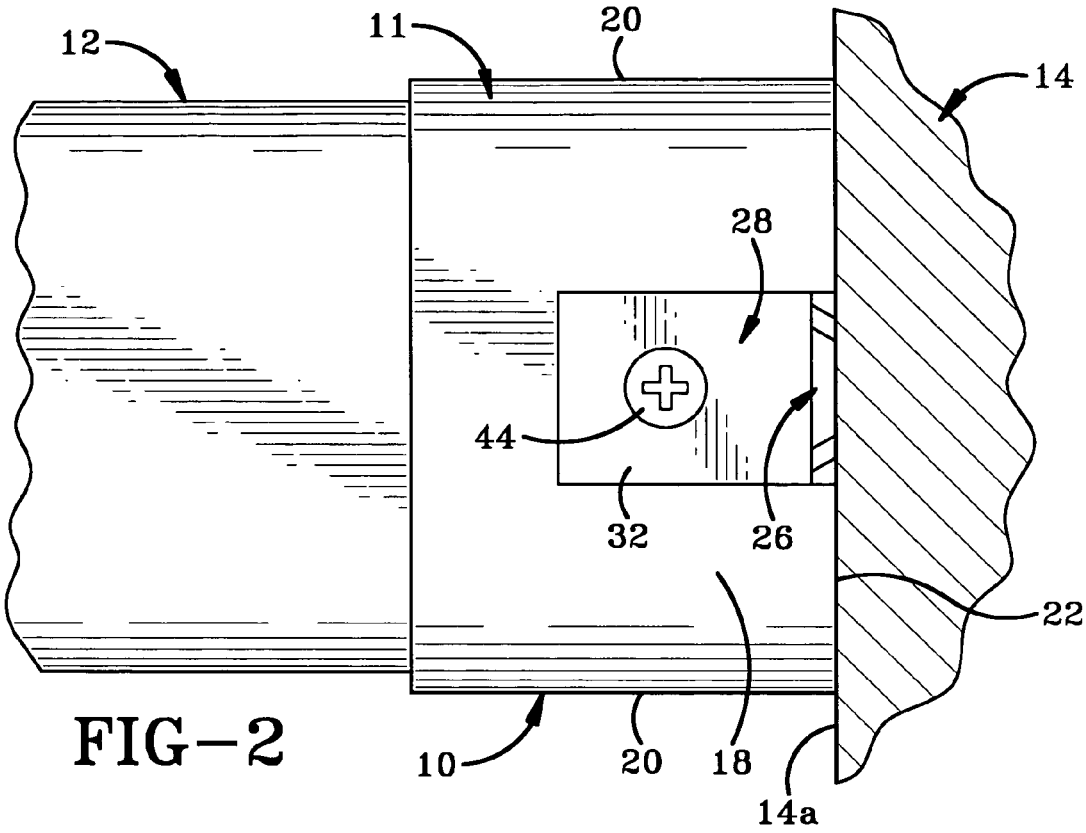
FIG. 2 is a partial cross-sectional bottom view of the fence rail and rail clip assembly of FIG. 1.
Figure 9:
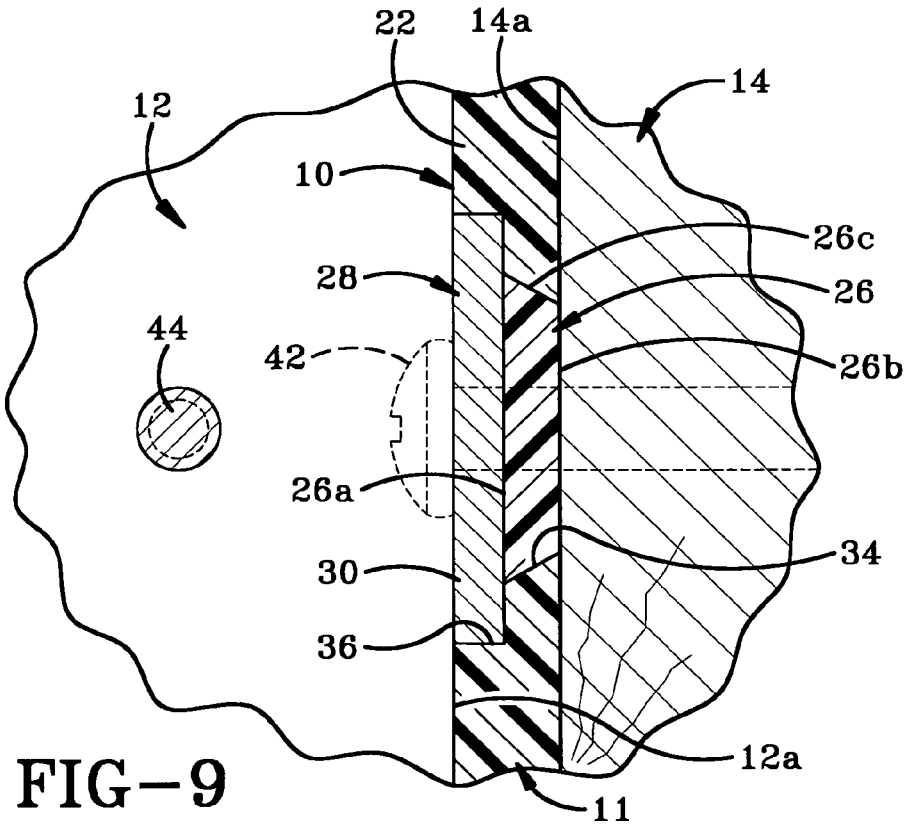
FIG. 9 is top view through line 9-9 of FIG. 7.
Figure 3:
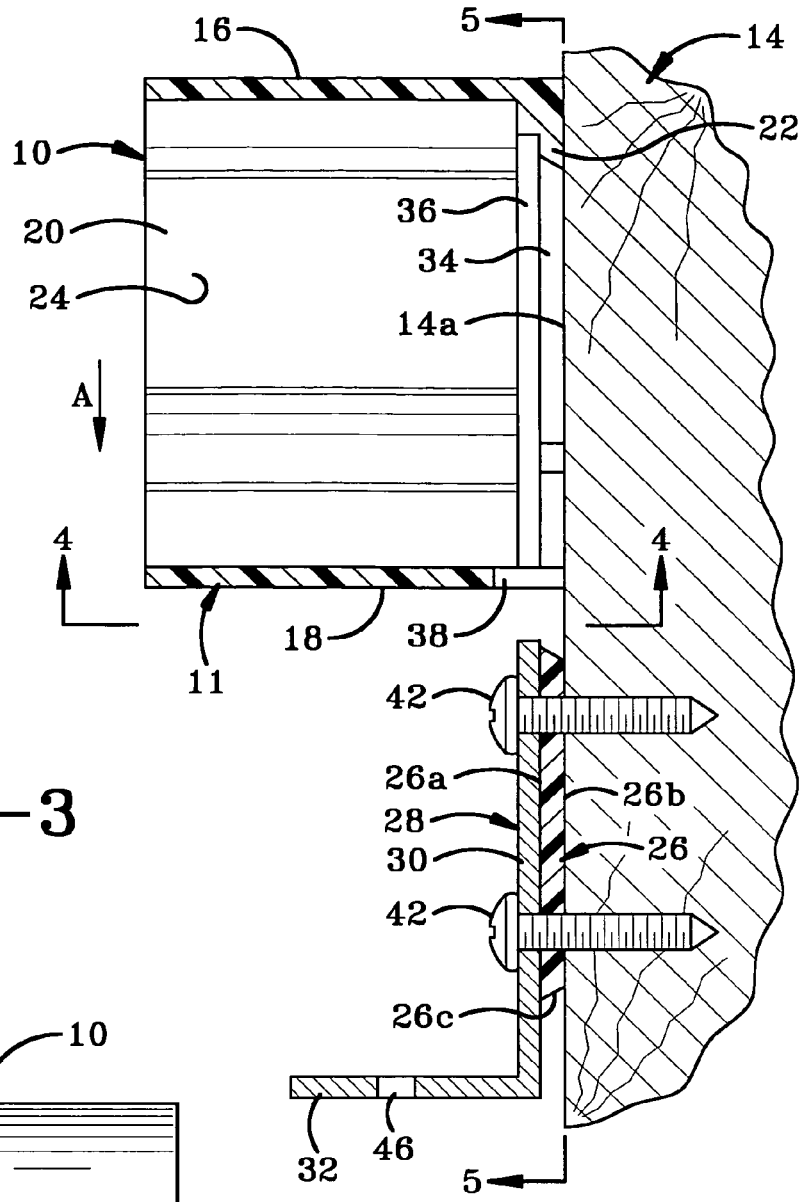
FIG. 3 is a cross-sectional side view of a fence rail being engaged with the rail clip assembly of the present invention.
Figure 4:
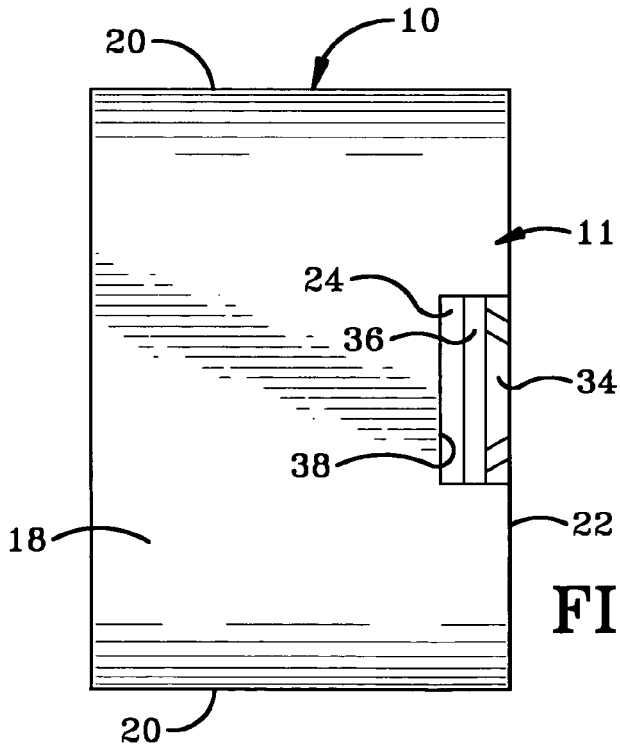
FIG. 4 is a bottom view of the rail clip assembly through line 4-4 of FIG. 3.

Referring to FIGS. 2-4, rail clip assembly 10 preferably includes a housing 11 having a perimeter wall that comprises a top wall 16, a bottom wall 18, and side walls 20. Walls 16, 18 and 20 extend outwardly away from a rear wall 22. These walls preferably are integrally manufactured with each other by a process such as molding. The walls 16-22 surround and define an interior chamber 24 that is adapted to receive an end of rail 12 therein. Chamber 24 is complementary sized and shaped to snugly receive the end of rail 12 therein.

Housing 11 of rail clip assembly 10 is designed to be secured to post 14 by two components, namely a mounting base 26 and an L-shaped mounting bracket 28. Base 26 is a substantially planar member having a front surface 26*a* and a back surface 26*b* and a peripheral wall 26*c*. As may be seen from FIGS. 3&5, peripheral wall 26*c* tapers from front surface 26*a* to back surface 26*b*. Base 26 preferably is manufactured from the same material as housing 11. Bracket 28 comprises a substantially L-shaped member having a first leg 30 and a second leg 32. Preferably, bracket 28 is manufactured from a suitable metal. Housing 11 is designed to engage both base 26 and bracket 28. Housing 11 includes a complementary tapered first recess 34 that is configured to tightly receive base 26 therein. Rail clip assembly further includes a second recess 36 that is differently shaped to first recess 34, and is configured to receive the first leg 30 of bracket 28 therein. First and second recesses preferably are substantially continuous with each other. Furthermore, second recess 36 is also substantially continuous with interior cavity 24 of housing 11. An opening 38 (FIG. 4) to both of first and second recesses 34, 36 is provided in bottom wall 18 of housing 11. Recess 34 preferably also has an opening 40 (FIG. 5) in rear wall 22 of housing 11. Opening 40 is smaller than the back surface 26*b* of base 26 so that base 26 cannot pass through opening 40.

Referring to FIG. 3, rail clip assembly 10 is used in the following manner to secure rail 12 to post 14. Back surface 26*b* of base 26 is placed into abutting contact with the outer surface 14*a* of post 14. The first leg 30 of the L-shaped bracket 28 is placed into abutting contact with front surface 26*a* of base 26. Fasteners 42 are used to secure both first leg 30 of bracket 28 and base 26 to post 14. It will be understood that both the first leg 30 and base 26 preferably are provided with appropriate holes for receiving fasteners 42 therethrough, so that the correct positioning of the two components is ensured. Alternatively, however, holes may be drilled through first leg 30 and base 26 during installation of rail clip assembly 10. When bracket 28 and base 26 are secured to post 14, the second leg 32 of bracket 28 extends outwardly away from the exterior wall of post 14 and substantially at right angles thereto.

Figure 5:
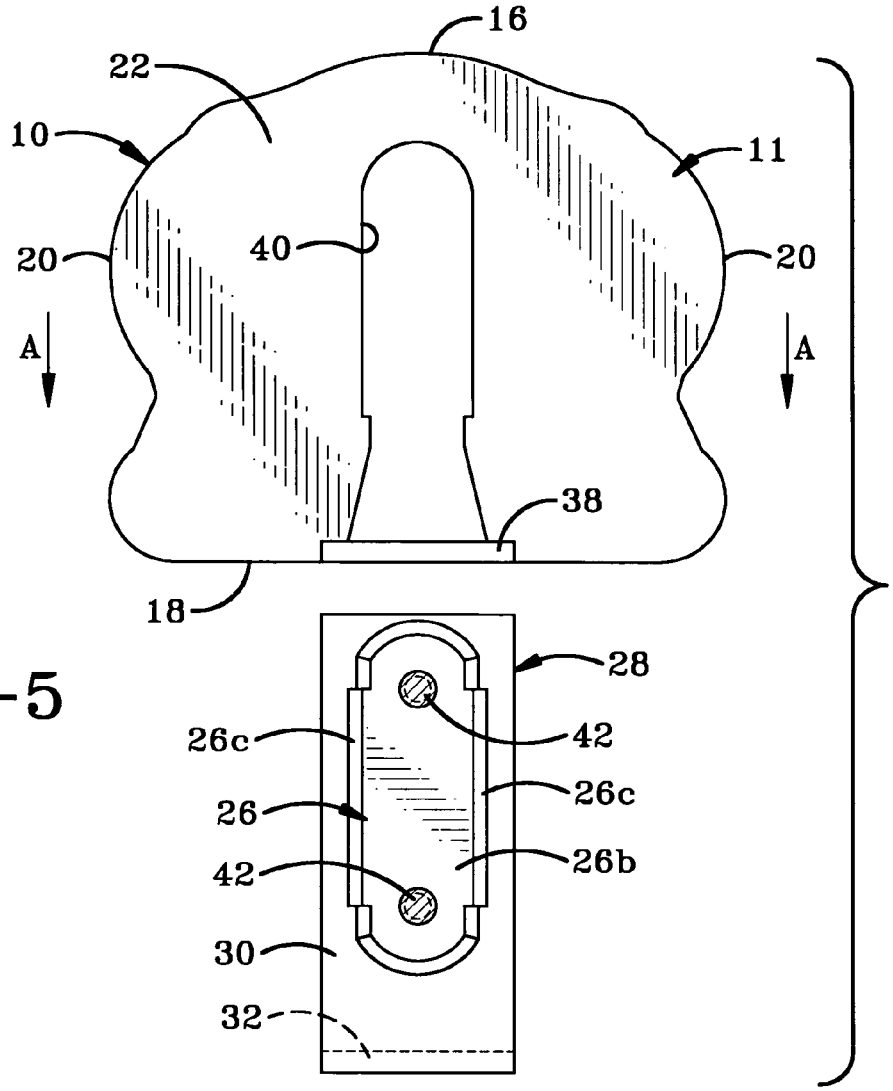
FIG. 5 is a rear view of the rail clip assembly, mounting bracket and mounting base taken through line 5-5 of FIG. 3.
Figure 8:
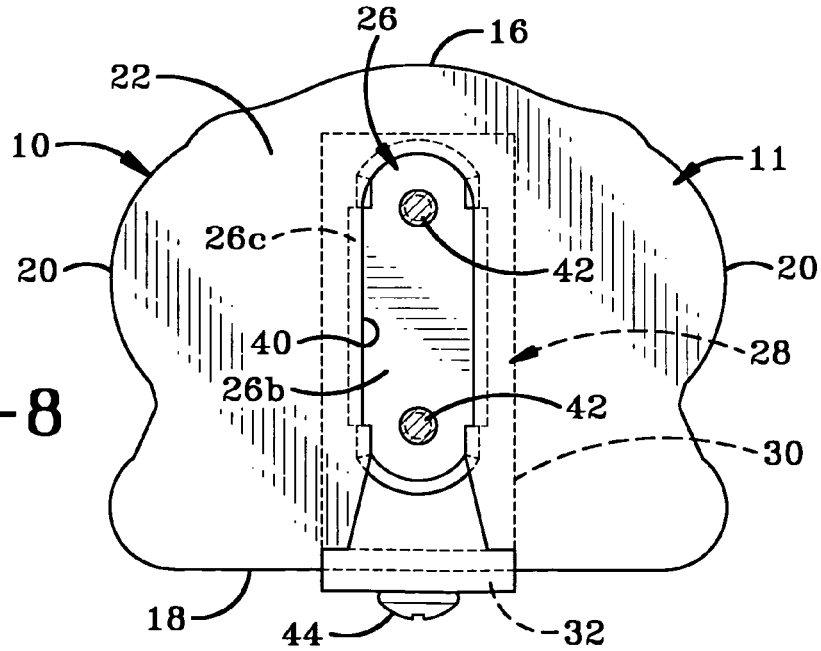
FIG. 8 is a rear view of the rail clip assembly engaged with the rail and taken through line 8-8 of FIG. 7.
Figure 6:
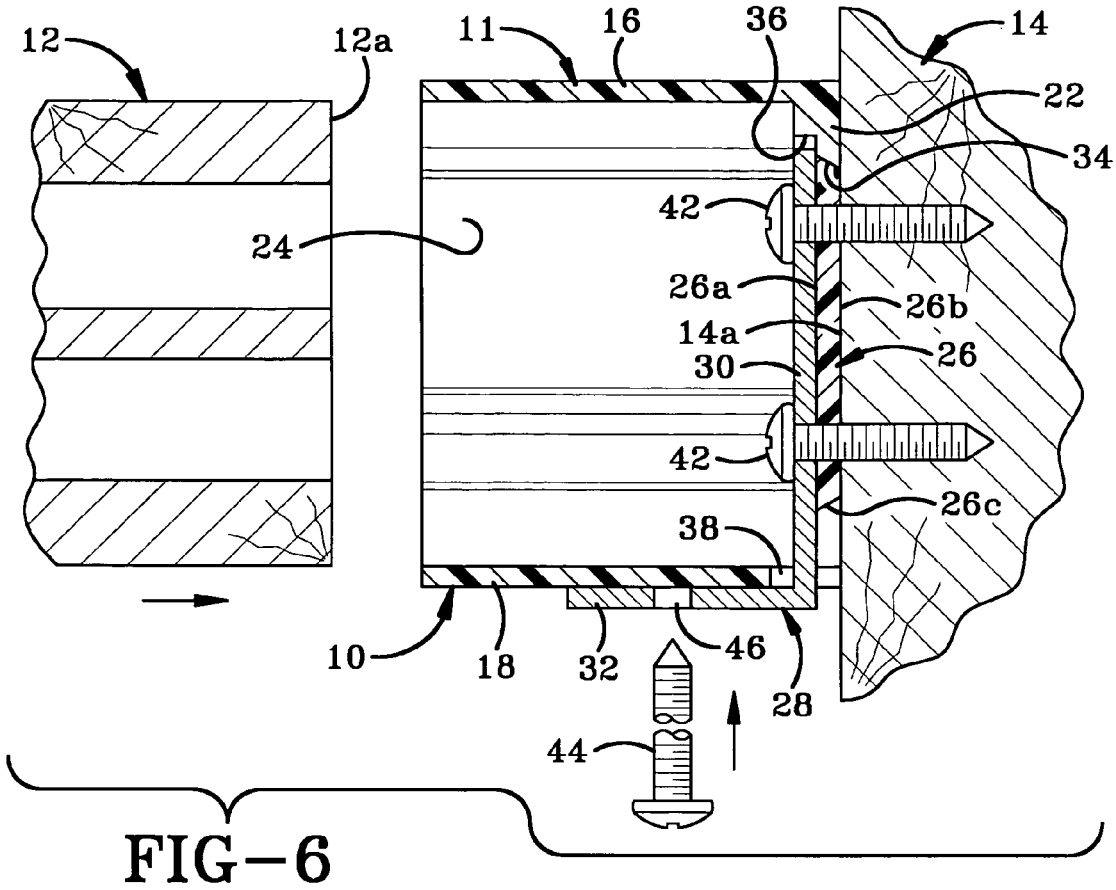
FIG. 6 is cross-sectional side view of the rail being inserted into the rail clip assembly.
Figure 7:
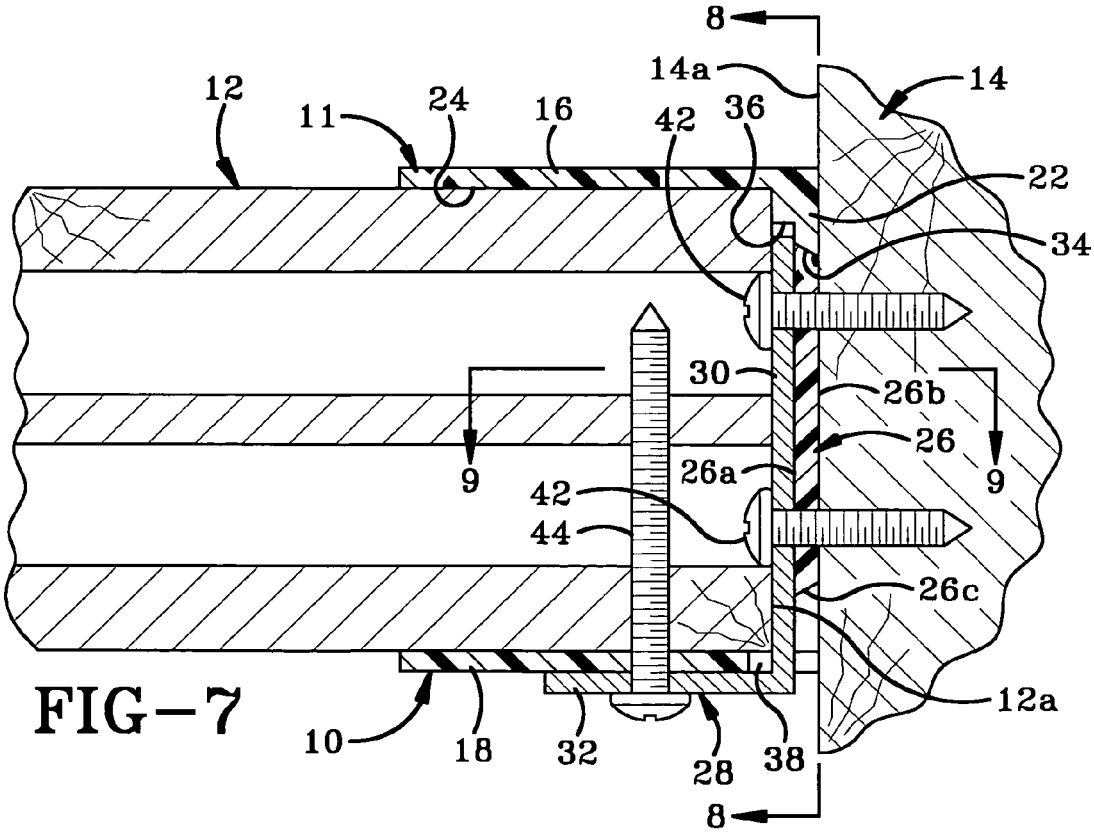
FIG. 7 is a cross-sectional side view of the rail secured to the rail clip assembly.

Rear wall 22 of housing 11 is then placed in abutting contact with outer surface 14*a* of post 14 and is slid downwardly in the direction of arrow "A" (FIGS. 3&5). This downward movement causes the uppermost ends of base 26 and first leg 30 of bracket 28 to enter first and second recesses 34, 36. Housing 11 is moved downwardly until bottom wall 18 abuts second leg 32 of bracket 28. An end of rail 12 is then inserted into cavity 24 of housing 11 (FIG. 6). Once the outermost end 12*a* abuts a portion of rear wall 22 of housing 11 and first leg 30 of bracket 28, a second fastener 44 is inserted through hole 46 in bracket 28 and is screwed through bottom wall 18 of housing 11 and into rail 12 (FIG. 7). This securement substantially prevents rail 12 from being withdrawn from cavity 24. Furthermore, the fastener 44 also prevents rail 12 from being moved laterally and causing rail 12 and rail clip assembly 10 to be dislodged from base 26.

Figure 10:
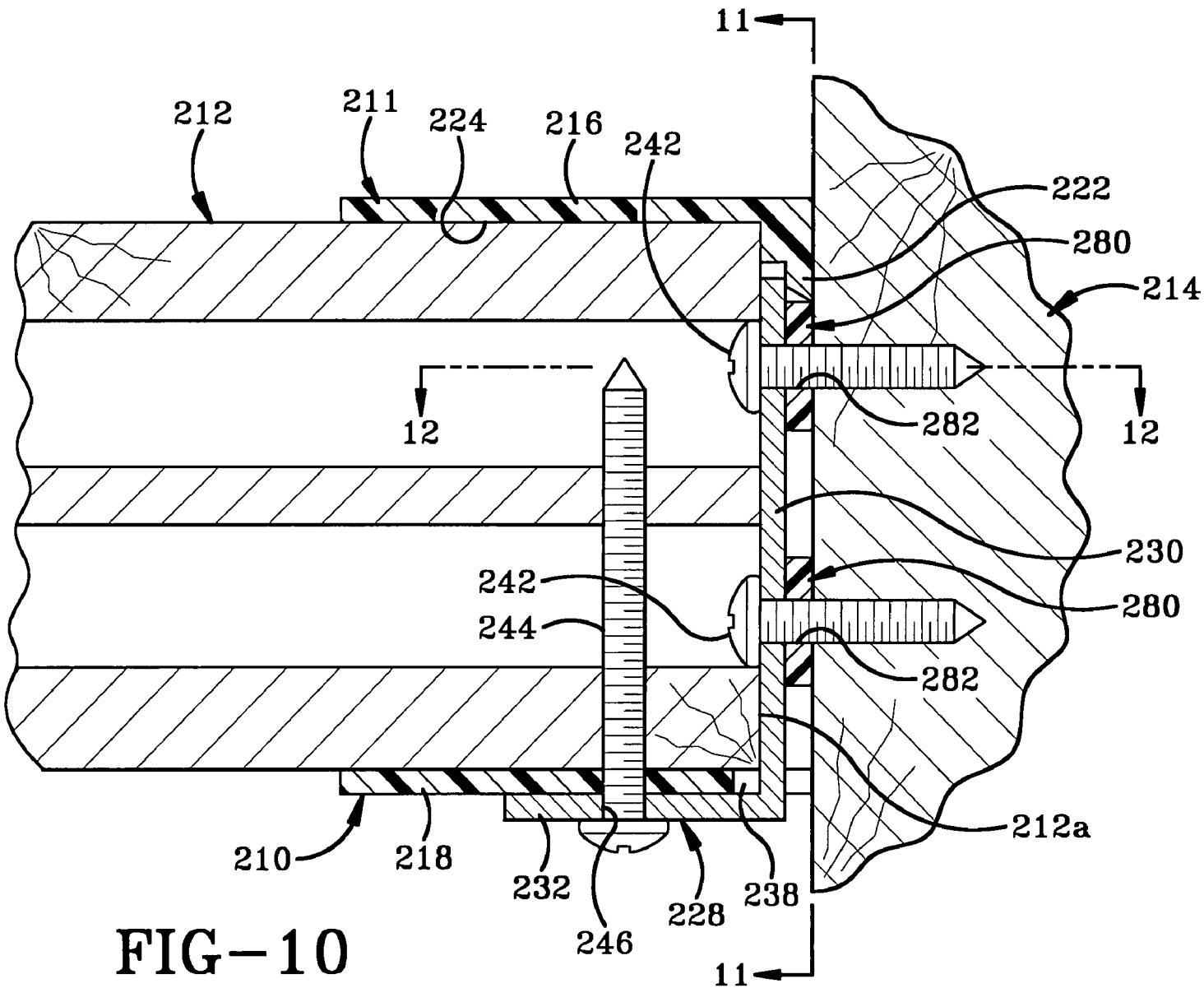
FIG. 10 is a cross-sectional side view of a second embodiment of the rail clip assembly in accordance with the present invention.
Figure 11:
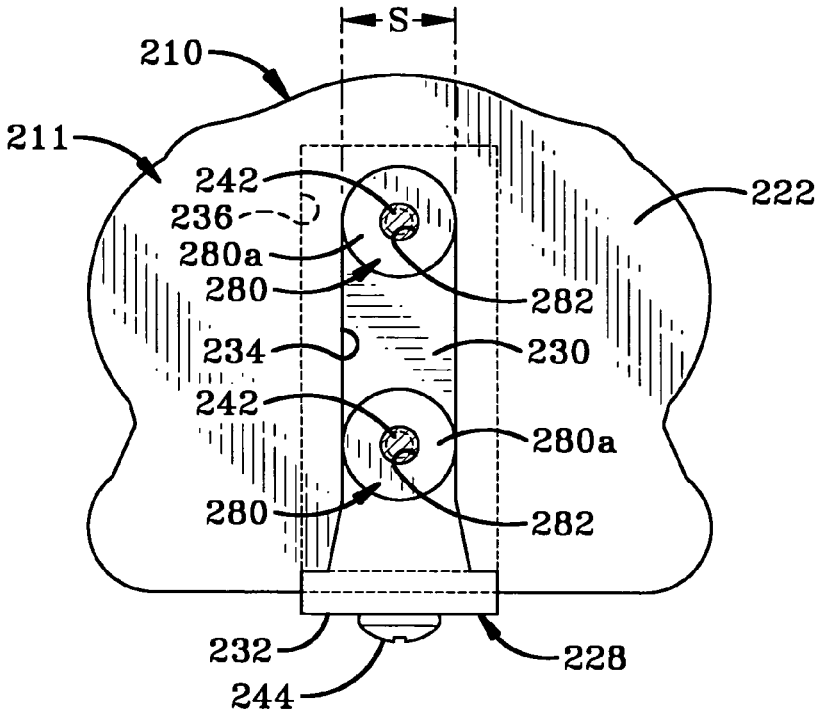
FIG. 11 is a rear view of the rail and rail clip assembly through line 11-11 of FIG. 10.
Figure 12:
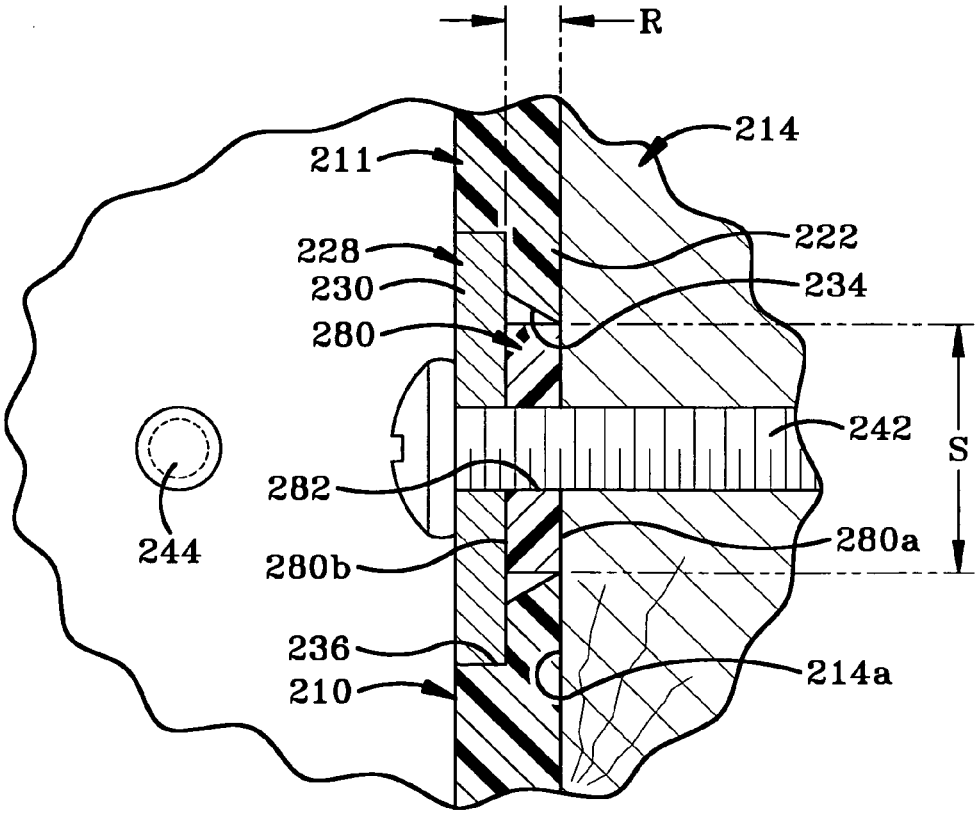
FIG. 12 is a top view of the rail and rail clip assembly through line 12-12 of FIG. 10.

FIGS. 10-12 show an alternative embodiment of a rail clip assembly in accordance with the present invention and generally indicated at 210. Rail clip assembly 210 is substantially identical to clip 10 in that it includes a housing 211 having a perimeter wall that comprises a top wall 216, a bottom wall 218, side walls (not shown) and a rear wall 222. The walls 216-222 surround and define an interior chamber 224 that is adapted to receive an end of rail 212 therein. Rear wall 222 is provided with a tapered first recess 234 and a second recess 236 that is contiguous therewith. First recess 234 is smaller in area than is second recess 236. Bottom wall 218 of housing 211 includes a first aperture 238 therein that is sufficiently wide enough to receive both first leg 230 of mounting bracket 228 and mounting spacer 280 therethrough as shown in FIG. 12.

Housing 211 is designed to be secured to post 214 by one or more mounting spacers 280 and an L-shaped mounting bracket 228. Mounting spacers 280 are used in the place of base 26 and are washer-like members that are sized to be received within the tapered first recess 234 in housing 211. First recess 234 has a depth "R" (FIG. 12) and each mounting spacer 280 has a substantially equal thickness "R". First recess 234 further has a narrowest width "S" and each mounting spacer has a diameter that is substantially equal to that width "S". Mounting spacers 280 preferably are manufactured from the same material as housing 211 and have a back surface 280*a*, a front surface 280*b* and a central aperture 282 therein. Bracket 228 is substantially identical to bracket 28 and is complementary shaped to be received within second recess 236 in housing 211.

Rail clip assembly 210 is used in the following manner to secure rail 212 to post 214. Back surface 280*a* of each mounting spacer 280 is placed into abutting contact with the outer surface 214*a* of post 214. The first leg 230 of the L-shaped bracket 228 is placed into abutting contact with front surfaces 280*b* of mounting spacers 280. Fasteners 242 are used to secure both first leg 230 of bracket 228 and mounting spacers 280 to post 214. It will be understood that both the first leg 230 and mounting spacers 280 preferably are provided with appropriate holes, such as central aperture 282 in mounting spacers 280, for receiving fasteners 242 therethrough. This ensures the correct positioning of the components. Alternatively, however, holes may be drilled through first leg 230 and mounting spacers 280 during installation of rail clip assembly 210. When bracket 228 and mounting spacers 280 are secured to post 214, the second leg 232 of bracket 228 extends outwardly away from the exterior wall of post 214 and substantially at right angles thereto.

Rear wall 222 of housing 211 is then placed in abutting contact with outer surface 214*a* of post 214 and is slid downwardly in the direction of arrow "X" (FIG. 10). This downward movement causes mounting spacers 280 and first leg 230 of bracket 228 to enter first and second recesses 234, 236, respectively. Housing 211 is moved downwardly until bottom wall 218 abuts second leg 232 of bracket 228. An end of rail 212 is then inserted into cavity 224 of housing 211. Once the outermost end 212*a* abuts a portion of rear wall 222 of housing 211 and first leg 230 of bracket 228, a second fastener 244 is inserted through hole 246 in bracket 228 and is screwed through bottom wall 218 of housing 211 and into rail 212 (FIG. 10). This securement substantially prevents rail 212 from being withdrawn from cavity 224. Furthermore, the fastener 244 also prevents rail 212 from being moved laterally and causing rail 212 and housing 211 to be disengaged from base 226.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A rail clip assembly for securing a fence rail to a fence post; said assembly comprising:

a housing having a perimeter wall and a rear wall that together define an interior chamber adapted to receive an end of the fence rail therein; and wherein said rear wall defines a first recessed area therein;

at least one mounting spacer sized to be received in a portion of the first recessed area; and wherein an exterior surface of the spacer and the rear wall of the housing are adapted to abut the fence post; and an interior surface of said spacer is disposed substantially parallel to the rear wall of the housing and within the interior chamber;

a mounting bracket having a first leg and a second leg angled from the first leg; whereby said first leg is in abutting contact with an interior surface of the mounting spacer and the second leg is in abutting contact with an exterior surface of the perimeter wall of the housing; and said second leg is secured to both of the perimeter wall and the fence rail; and a first fastener adapted to secure the first leg of the mounting bracket to both of the mounting spacer and the fence post such that the mounting spacer is located between the first leg and the fence post.

2. The rail clip assembly as defined in claim 1, wherein the perimeter wall comprises a top wall, a bottom wall and opposing side walls which extend outwardly away from the rear wall of the housing; and wherein said bottom wall defines a first aperture therein; and wherein both of the mounting spacer and said first leg of said mounting bracket are receivable through said first aperture; whereby said second leg extends forwardly away from the rear wall and adjacent the bottom wall of the housing.

3. The rail clip assembly as defined in claim 2, wherein the first aperture is sufficiently wide enough to receive both the first leg of the mounting bracket and the mounting spacer therethrough.

4. The rail clip assembly as defined in claim 1, wherein an inner surface of the rear wall defines a second recessed area therein that is contiguous with the first recessed area, and said first recessed area is smaller than the second recessed area; and wherein the first leg of the mounting bracket is received within the second recessed area.

5. The rail clip assembly as defined in claim 4, wherein the second recessed area substantially surrounds the first recessed area.

6. The rail clip assembly as defined in claim 1, wherein the first recess is of a first depth and the mounting spacer has a thickness that is substantially equal to the first depth.

7. The rail clip assembly as defined in claim 1, wherein the first fastener is receivable through the first leg of the mounting bracket and a central aperture in the mounting spacer and is adapted to secure the mounting bracket and mounting spacer to the fence post.

8. The rail clip assembly as defined in claim 1, wherein the first leg has a width and the width of the first leg is greater than the diameter of the mounting spacer.

9. The rail clip assembly as defined in claim 1, further comprising a second mounting spacer sized to be received within a second portion of the first recess a spaced distance from the mounting spacer; and further comprising a second first fastener that is adapted to secure the second mounting spacer and first leg of the mounting bracket to the fence post.

10. The rail clip assembly as defined in claim 1, wherein the perimeter wall of the housing includes a top wall and a bottom wall; and the assembly further includes a second fastener; and wherein the second leg of the mounting bracket is secured to the exterior surface of the bottom wall by the second fastener; and wherein the second fastener is further adapted to secure the second leg and the bottom wall to the rail.

11. The rail clip assembly as defined in claim 1, further comprising a second fastener that is adapted to secure the second leg of the mounting bracket to the perimeter wall of the housing and to the rail.

12. In combination:

a fence rail;

a fence post; and a rail clip assembly for connecting the post and rail together; wherein the rail clip assembly comprises:

a housing configured to receive an end of the rail therein;

a mounting bracket having a first part and a second part, wherein the first part is received within the housing and is disposed substantially parallel to an interior surface of a rear wall of said housing, and the second part abuts an exterior surface of a bottom wall of the housing, and said second part is secured to both of a perimeter wall and the fence rail;

at least one mounting spacer that is frictionally received within a first recess formed in the rear wall of the housing; and wherein the first part of the mounting bracket is in abutting contact with an interior surface of the mounting spacer; and a first fastener secures the first part of the mounting bracket to both of the mounting spacer and the fence post such that the mounting spacer is located between the first part and the fence post.

13. The combination as defined in claim 12, further comprising a second fastener that secures the second part of the mounting bracket and the bottom wall of the housing to the rail.

14. The combination as defined in claim 12, further comprising a second mounting spacer that is frictionally received within the first recess in the rear wall of the housing; and wherein said second mounting spacer is connected to the mounting bracket a spaced distance from the mounting spacer by a second first fastener.

* * * * *